US009834344B2

(12) United States Patent
Hsu

(10) Patent No.: US 9,834,344 B2
(45) Date of Patent: Dec. 5, 2017

(54) WET WIPE SEALING CAP STRUCTURE

(71) Applicant: DONZEE ENTERPRISE LTD., Taichung (TW)

(72) Inventor: Jin-Yang Hsu, Taichung (TW)

(73) Assignee: DONZEE ENTERPRISE LTD., Taichung (TW)

( * ) Notice: Subject to any disclaimer, the term of this patent is extended or adjusted under 35 U.S.C. 154(b) by 161 days.

(21) Appl. No.: 15/014,643

(22) Filed: Feb. 3, 2016

(65) Prior Publication Data

US 2017/0129660 A1 May 11, 2017

(30) Foreign Application Priority Data

Nov. 6, 2015 (TW) ..... 104136608 A

(51) Int. Cl.

| | |
|---|---|
| ***B65D 47/14*** | (2006.01) |
| ***A47K 10/42*** | (2006.01) |
| ***B65D 51/18*** | (2006.01) |
| ***B65D 75/58*** | (2006.01) |
| ***B65D 83/08*** | (2006.01) |
| *B65D 47/08* | (2006.01) |
| *A47K 10/32* | (2006.01) |

(52) U.S. Cl.

CPC ..... *B65D 47/14* (2013.01); *A47K 10/421* (2013.01); *B65D 51/18* (2013.01); *B65D 75/5877* (2013.01); *B65D 83/0805* (2013.01); *A47K 2010/3266* (2013.01); *B65D 47/088* (2013.01); *B65D 2251/009* (2013.01); *B65D 2251/0025* (2013.01); *B65D 2251/0028* (2013.01); *B65D 2251/0087* (2013.01)

(58) Field of Classification Search

CPC ..... A47J 47/04; A47K 2010/3266; A47K 10/421; B65D 43/162; B65D 47/088; B65D 51/24; B65D 51/26; B65D 83/0805

USPC ..... 206/494

See application file for complete search history.

(56) References Cited

FOREIGN PATENT DOCUMENTS

| | | |
|---|---|---|
| TW | 535555 U | 6/2003 |
| TW | I461335 B | 11/2014 |

*Primary Examiner* — Anthony Stashick
*Assistant Examiner* — Mollie Impink
(74) *Attorney, Agent, or Firm* — Muncy, Geissler, Olds & Lowe PC

(57) ABSTRACT

A wet wipe sealing cap structure includes a base ring including a circular upright wall, an annular shoulder horizontally outwardly extended from the circular upright wall and an outer locating unit and an inner locating unit respectively located at opposing inner and outer perimeters of the circular upright wall, a claw plate detachably fastened to the base ring, and a cover device including a collar coupled to the circular upright wall, a cap removably capped on the circular upright wall and a flexible member connected between the cap and the collar. The cap includes a circular cover plate, a cover wall perpendicularly extended around the border edge of the cover plate, an annular inner wall downwardly extended from the cover plate, and a bottom slope located at the annular inner wall.

8 Claims, 7 Drawing Sheets

WET WIPE SEALING CAP STRUCTURE

BACKGROUND OF THE INVENTION

1. Field of the Invention

The present invention relates to sealing technology and more particularly, to a wet wipe sealing cap structure.

2. Description of the Related Art

In order to reduce escape of water vapor, commercial wet wipe packs generally provide a re-sealable sealing tag for sealing the opening. In service, the user needs to open the re-sealable sealing tag from the opening, and then to seal the re-sealable sealing tag to the bag again after pick up of one piece of wet wipe from the bag. However, because the re-sealable sealing tag is a flexible material and the bag is also flexible and the shape of the bag is highly changeable, the re-sealable sealing tag can be not well sealed to the surface of the bag due to surface irregularities, and thus, this design can simply provide a dustproof effect without achieving an airtight sealing effect. Further, because the opening of the bag for the access of the fingers to the storage wet wipes has a large size, a large area of the storage wet wipes will be kept in direct contact with the outside air when the user opens the re-sealable sealing tag, causing escape of water vapor out of the inside of the bag into the outside open air. Further, after several times of use, the re-sealable sealing tag will be contaminated with water, dust or hairs, weakening or loosening its stickiness to further lose its adhesive effect.

In order to solve the aforesaid problem, Taiwan Patent Number 535555 teaches a technique of adhering a buckle cap member around an opening of a cover. Because of needing to cover the whole re-sealable sealing tag, this design cannot achieve satisfactory airtight sealing effects and can simply provide a dustproof function. This technique avoids loosening of the airtight sealing effect due to loosening of the stickiness of the re-sealable sealing tag, however, when taking one piece of wet wipe, a large area of the opening of the bag is kept in direct contact with external air, enabling water vapor to escape out of the bag into the outside open space. Thus, a certain amount of water vapor will escape out of the bag upon each use, and the storage wet wipes will become dry quickly.

Taiwan Patent I 461335, issued to the present inventor, discloses a wet wipe sealing cap structure consisting of cap combination, an upper positioning member and a lower positioning member. By means of these three components, the wet wipe sealing cap structure provides a good sealing effect, preventing water vapor from escaping out of the bag or box and maintaining wettability of the storage wet wipes. In application, the wet wipe sealing cap structure needs to be assembled with the box, however, the thickness of the box brings trouble on the assembly process. Further, if the leading piece of wet wipe falls to the inside of the box, the leading piece of wet wipe cannot be set back in position without disassembling the wet wipe sealing cap structure. Thus, this design of wet wipe sealing cap structure is still not convenient in use. It still has room for improvement on airtight sealing arrangement.

SUMMARY OF THE INVENTION

The present invention has been accomplished under the circumstances in view. It is the main object of the present invention to provide a wet wipe sealing cap structure, which facilitates the assembly process.

It is another object of the present invention to provide a wet wipe sealing cap structure, which achieves excellent airtight sealing effects to prevent quick escape of water vapor out of the container into the outside open air.

To achieve these and other objects of the present invention, a wet wipe sealing cap structure comprises a base ring, a claw plate and a cover device. The base ring comprises a circular upright wall, an annular shoulder horizontally and outwardly extended from a bottom edge of the circular upright wall, an outer locating unit located at an outer perimeter of the circular upright wall, and an inner locating unit located at an inner perimeter of the circular upright wall. The claw plate comprises an outer race, a plurality of claws radially inwardly extended from the outer race toward the center of the claw plate and equally spaced from one another, and a claw plate engagement unit located at the periphery of the outer race and detachably engageable with the inner locating unit to secure the claw plate to the inside of the base ring. The cover device comprises a cap detachably capped on the circular upright wall and positioned between the outer locating unit and the annular shoulder, a collar and a flexible member connected between the cap and the collar. The cap comprises a circular cover plate, a cover wall perpendicularly extended around the border edge of the cover plate, and a cover engagement unit located at an inner surface of the cover wall. The cap is detachably downwardly capped on the topmost edge of the circular upright wall with the cover plate facing upwards and the cover wall facing downwards to force the cover engagement unit into friction engagement with the outer locating unit. The cap further comprises an annular inner wall downwardly extended from a bottom surface of the cover plate, and a bottom slope of a predetermined height located at a bottom part of the annular inner wall. The base ring further comprises a top slope of a predetermined height located at a top part of the circular upright wall and matching the bottom slope of the cap. When capping the cap onto the base ring, the bottom slope of the annular inner wall is abutted against the top slope of the circular upright wall.

Thus, the present invention facilitates the assembly of the wet wipe sealing cap structure. When compared to the prior art design, the invention facilitates the assembly process. Subject to abutment between the bottom slope and the top slope, the invention achieves excellent airtight sealing effects to prevent escape of water vapor out of the container into the outside open air.

Other advantages and features of the present invention will be fully understood by reference to the following specification in conjunction with the accompanying drawings, in which like reference signs denote like components of structure.

DETAILED DESCRIPTION OF THE INVENTION

Figure 1:
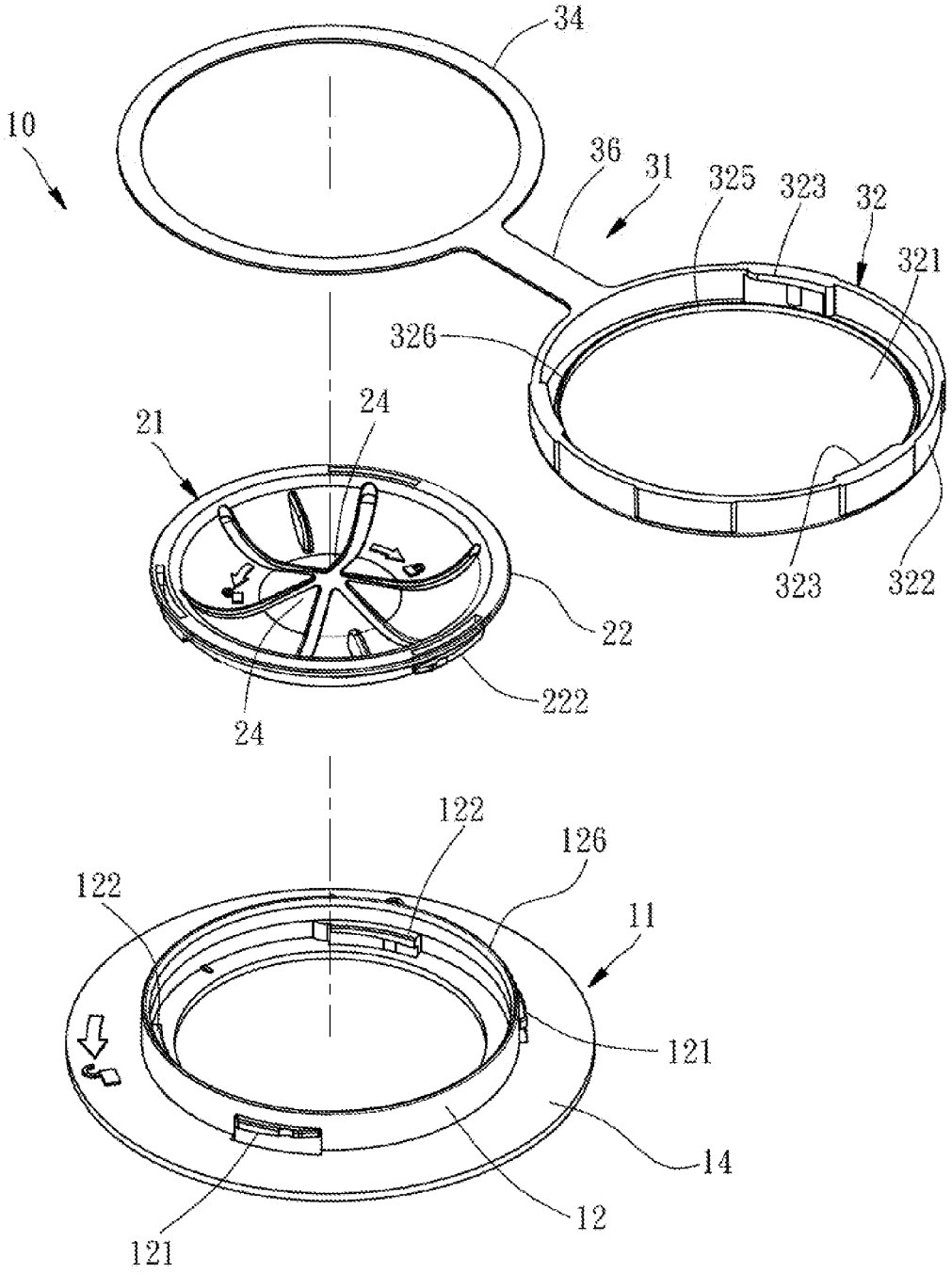
FIG. 1 is an exploded view of a wet wipe sealing cap structure in accordance with the present invention.
Figure 2:
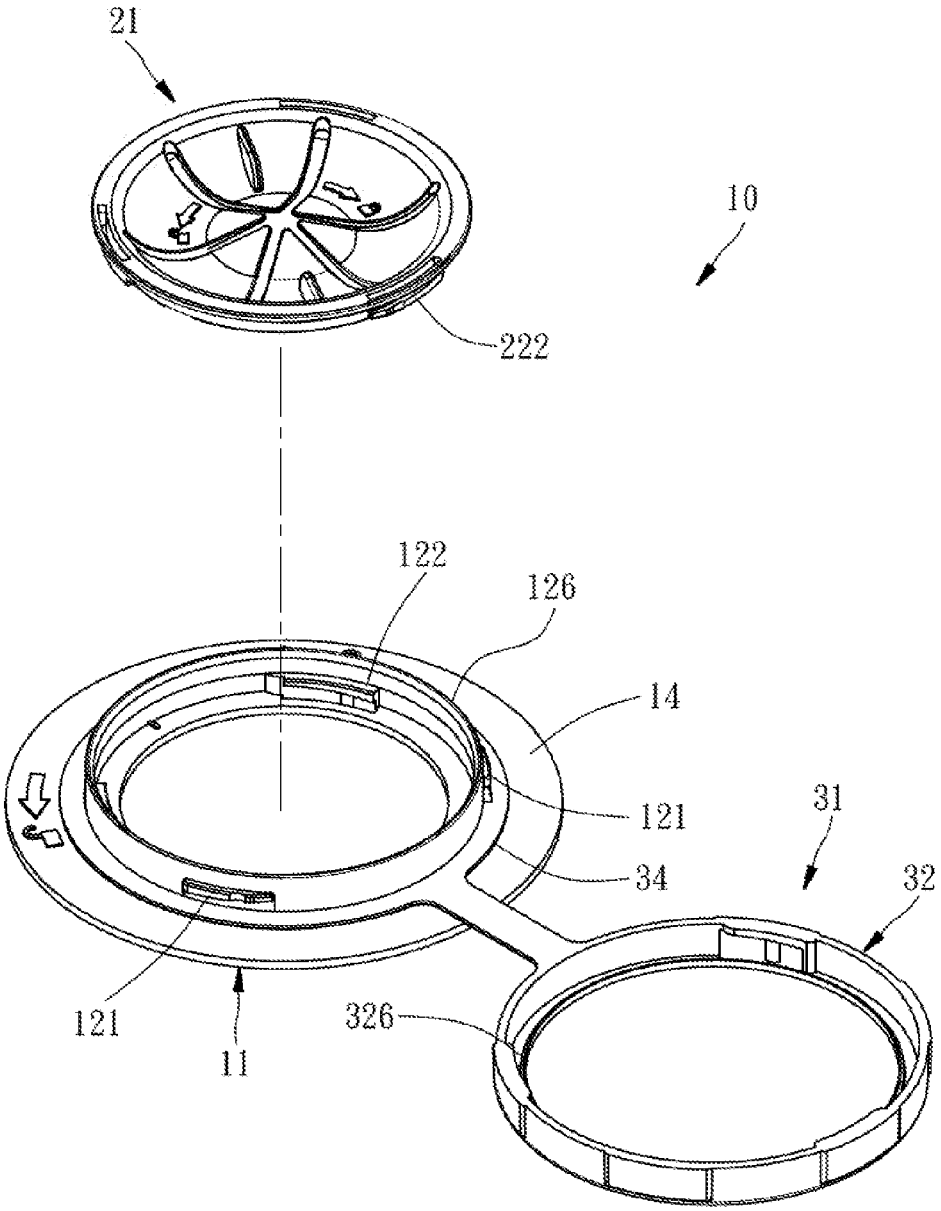
FIG. 2 is a schematic exploded view of the present invention, illustrating the base ring and the cover device assembled before mounting of the claw plate in the base ring.
Figure 3:
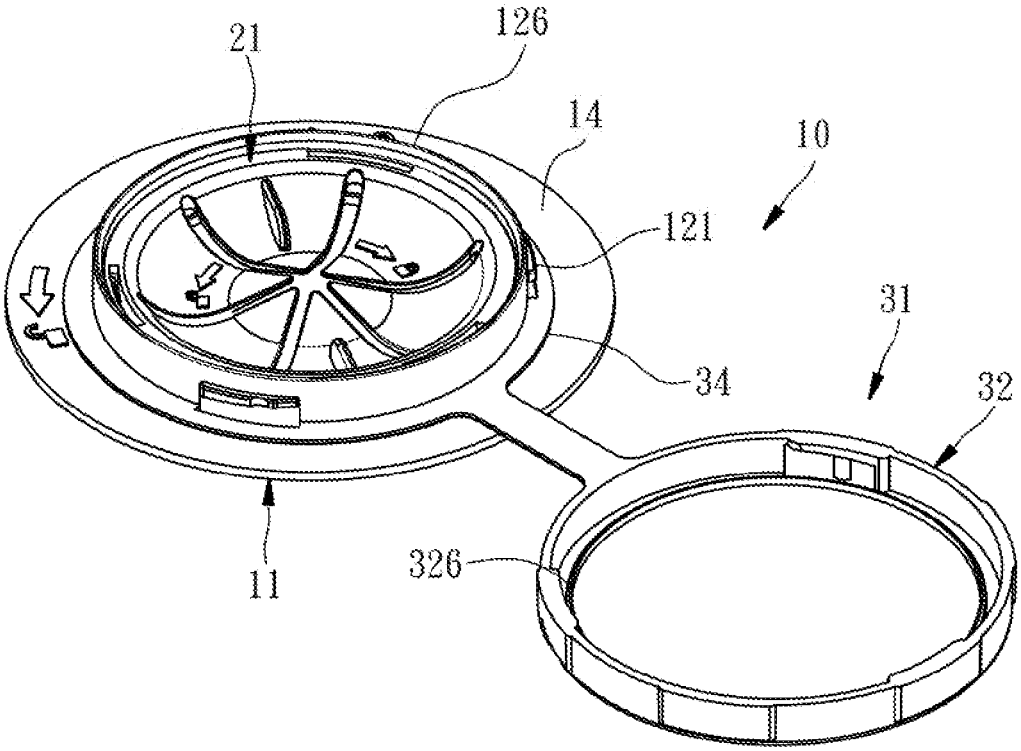
FIG. 3 illustrates the base ring, claw plate and cover device of the wet wipe sealing cap structure assembled before capping of the cap onto the circular upright wall of the base ring.
Figure 4:
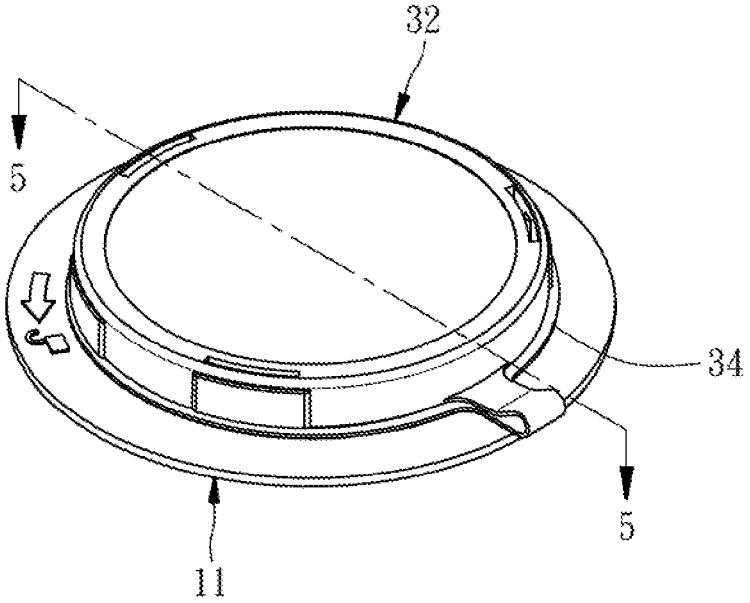
FIG. 4 corresponds to FIG. 3, illustrating the cap capped on the circular upright wall of the base ring.

Referring to FIGS. 1-6, a wet wipe sealing cap structure 10 in accordance with the present invention is shown. The wet wipe sealing cap structure 10 comprises a base ring 11, a claw plate 21 and a cover device 31.

The base ring 11 comprises a circular upright wall 12, an annular shoulder 14 horizontally and outwardly extended from a bottom edge of the circular upright wall 12, an outer locating unit 121 located at an outer perimeter of the circular upright wall 12, and an inner locating unit 122 located at an inner perimeter of the circular upright wall 12. In this embodiment, the outer locating unit 121 consists of a plurality of sloping ribs that are formed integral with and equiangularly spaced around the outer perimeter of the circular upright wall 12; the inner locating unit 122 consists of a plurality of sloping ribs formed integral with and equiangularly spaced around the inner perimeter of the circular upright wall 12.

The claw plate 21 comprises an outer race 22, a plurality of claws 24 radially inwardly extended from the outer race 22 toward the center thereof and equally spaced from one another, a claw plate engagement unit 222 located at the periphery of the outer race 22 and detachably engageable with the inner locating unit 122 to secure the claw plate 21 to the inside of the base ring 11. In this embodiment, the claw plate engagement unit 222 consists of a plurality of sloping ribs that are formed integral with and equiangularly spaced around the periphery of the outer race 22 of the claw plate 21.

The cover device 31 comprises a cap 32 detachably capped on the circular upright wall 12 and positioned between the outer locating unit 121 and the annular shoulder 14, a collar 34, and a flexible member 36 connected between the cap 32 and the collar 34. The cap 32 comprises a circular cover plate 321, a cover wall 322 perpendicularly extended around the border edge of the cover plate 321, a cover engagement unit 323 located at an inner surface of the cover wall 322. The cap 32 is detachably downwardly capped on the topmost edge of the circular upright wall 12 with the cover plate 321 facing upwards and the cover wall 322 facing downwards to force the cover engagement unit 323 into friction engagement with the outer locating unit 121. In this embodiment, the cap 32, the collar 34 and the flexible member 36 are integrally formed in one piece; the cover engagement unit 323 consists of a plurality of sloping ribs that are formed integral with and equiangularly spaced around the inner surface of the cover wall 322; the collar 34 is fastened to the circular upright wall 12 through a rotary motion. Further, in this embodiment, the inner diameter of the collar 34 is slightly larger than the outer diameter of the circular upright wall 12 so that the collar 34 can be accurately coupled to the circular upright wall 12; further, the inner diameter of the collar 34 is smaller than the outer diameter defined by the sloping rids of the outer locating unit 121, and thus, when coupling the collar 34 to the circular upright wall 12, the collar 34 can be forced downwardly over the outer locating unit 121 and positioned between the outer locating unit 121 and the annular shoulder 14 and then stopped by the outer locating unit 121 from falling out of the circular upright wall 12 subject to the design that the outer diameter defined by the sloping rids of the outer locating unit 121 is larger than the inner diameter of the collar 34.

The cap 32 further comprises an annular inner wall 325 downwardly extended from a bottom surface of the cover plate 321, and a bottom slope 326 located at a bottom part of the annular inner wall 325 and having a predetermined height. Further, a top slope 126 is located at a top part of the circular upright wall 12 and having a predetermined height matching the bottom slope 326 of the cap 32. When capping the cap 32 onto the base ring 11, the bottom slope 326 of the annular inner wall 325 is abutted against the top slope 126 of the circular upright wall 12. In this embodiment, the bottom slope 326 of the annular inner wall 325 is disposed at an outer side of the annular inner wall 325; the top slope 126 of the circular upright wall 12 is disposed at an inner side of the circular upright wall 12; the inner diameter of the annular inner wall 325 is smaller than the inner diameter of the circular upright wall 12.

After description of the architecture of the present preferred embodiment, the application of the wet wipe sealing cap structure 10 is outlined hereinafter.

Referring to FIGS. 1-7, before using the present invention, install the base ring 11 in a container 91 that accommodates therein interfolded wet wipes (wet towels, or moist towelettes) 99. The container 91 can be a flexible bag or hard box. In this embodiment, the container 91 is a hard box. In application, the bottom surface of the annular shoulder 14 of the base ring 11 can be affixed to the surface of the container 91 around the opening (not shown) of the container 91 with an adhesive. Thereafter, pull a part of the leading piece of wet wipe 99 out of the container 91 and enable this leading piece of wet wipe 99 to be secured in place by the claws 24 of the claw plate 21, and then attach the claw plate 21 to the base ring 11 to force the claw plate engagement unit 222 into friction engagement with the inner locating unit 122, and then couple the collar 34 to the circular upright wall 12 between the annular shoulder 14 and the outer locating unit 121. In the assembly process, the user can apply a pressure to the collar 34 to move the collar 34 over the outer locating unit 121. Subject to the matching design between the sloping ribs of the inner locating unit 122 and the sloping ribs of the claw plate engagement unit 222, the claw plate 21 can be positively secured to the inside of the base ring 11 through a rotary motion. At final, cap the cap 32 onto the circular upright wall 12 of the base ring 11. Subject to the matching design between the sloping ribs of the outer locating unit 121 and the sloping ribs of the cover engagement unit 323, the cap 32 can be positively secured to the circular upright wall 12 through a rotary motion. At the same time, the wet wipe 99 in the claw plate 21 is kept in the space between the cap 32 and the base ring 11 and secured in place by the claw plate 21, and, the bottom slope 326 of the cap 32 is stopped against the top slope 126 of the circular upright wall 12 to achieve excellent airtight sealing effects, preventing quick escape of water vapor from the wet wipe 99 in the claw plate 21 and the other wet wipes 99 in the container 91 into the outside open air.

When a user is going to pick up the leading piece of wet wipe 99 for application, rotate the cap 32 relative to the base ring 11 to unlock the cap 32 and then open the cap 32 from the base ring 11, and then pull the wet wipe 99 out of the claw plate 21, at this time, the succeeding piece of wet wipe 99 will be carried into the claw plate 21 and secured in place by the claws 24, at this time, the seizing force of the claws 24 is sufficient to achieve separation between this succeeding piece of wet wipe 99 in the claw plate 21 and the previous piece of wet wipe 99 that has been taken by the user. At final, the user can put the cap 32 back onto the base ring 11 and then fasten it tight, finishing the use.

Thus, as explained above, the present invention facilitates the assembly of the wet wipe sealing cap structure. After adhered the base ring 11 to the container 91 around the opening of the container 91, the claw plate 21 and the cover device 31 can be directly coupled to the claw plate 21. When compared to the prior art design, the invention facilitates the assembly process.

Further, subject to abutment between the bottom slope 326 and the top slope 126, the invention achieves excellent airtight sealing effects to prevent escape of water vapor out of the container 91 into the outside open air.

It's worth mentioning that in the present preferred embodiment, the design of the bottom slope 326 of the annular inner wall 325 at an outer side relative to the annular inner wall 325 and the top slope 126 of the circular upright wall 12 at an inner side relative to the circular upright wall 12 is simply an example to constitute an airtight sealing structure but not intended for use to limit the scope and spirit of the present invention. In actual application, this airtight sealing structure can be modified as: the bottom slope 326 of the annular inner wall 325 is disposed at an inner side relative to the annular inner wall 325, and, the top slope 126 of the circular upright wall 12 is disposed at an outer side relative to the circular upright wall 12. After adjustment of the inner diameter of the circular upright wall 12 of the base ring 11 and the inner diameter of the annular inner wall 325 of the cap 32, the bottom slope 326 can be abutted against the top slope 126 to achieve same airtight sealing effects.

Figure 5:
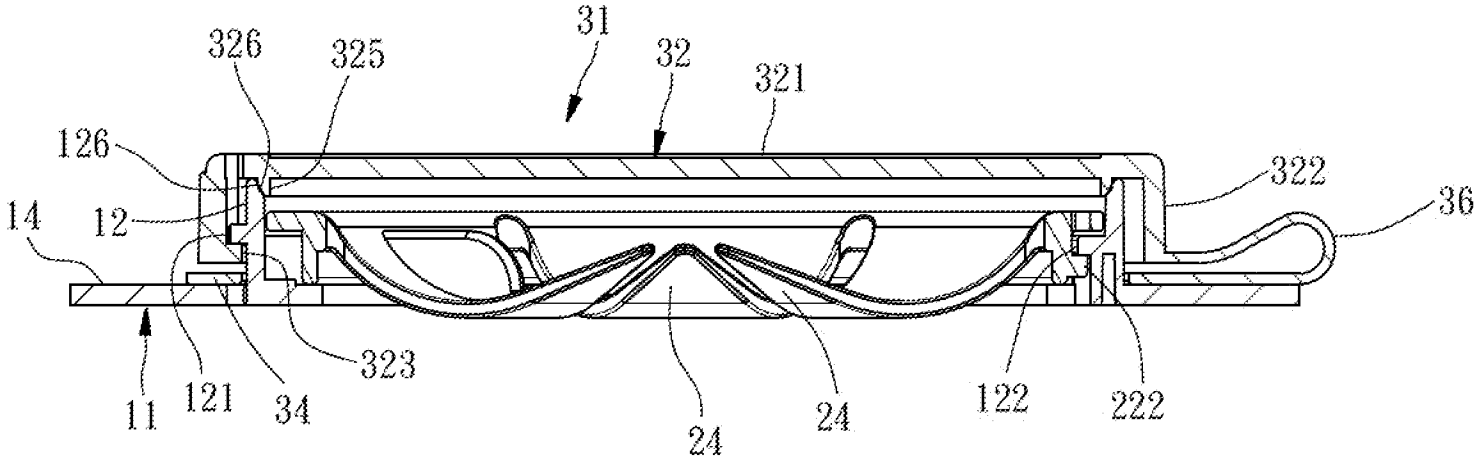
FIG. 5 is a sectional view taken along line 5-5 of FIG. 4.
Figure 6:
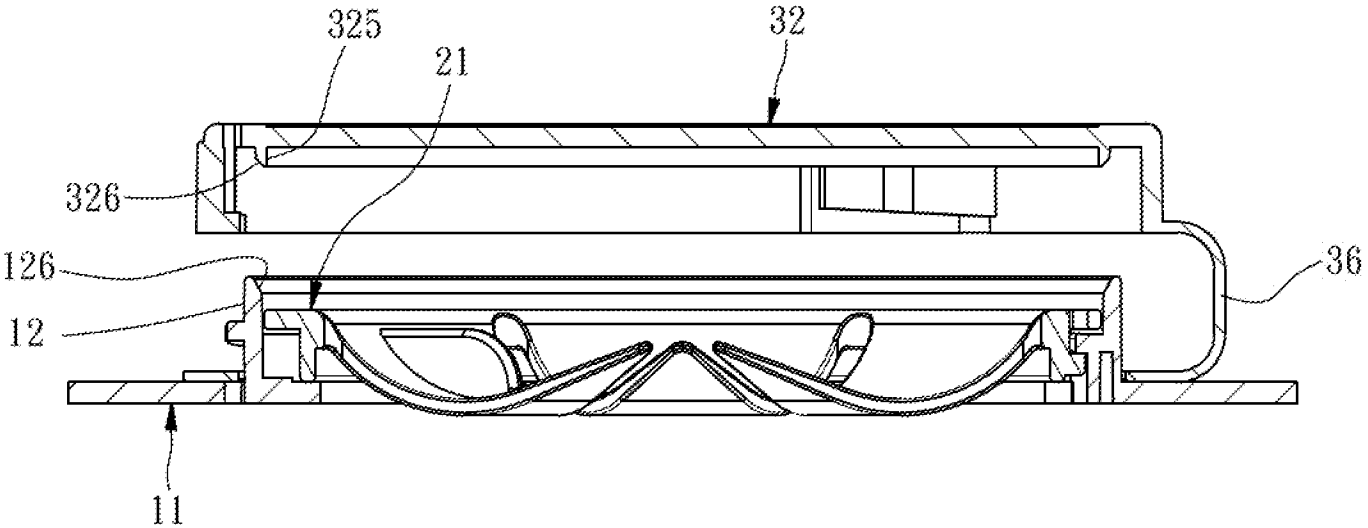
FIG. 6 is similar to FIG. 5, illustrating the cap disconnected from the base ring.
Figure 7:
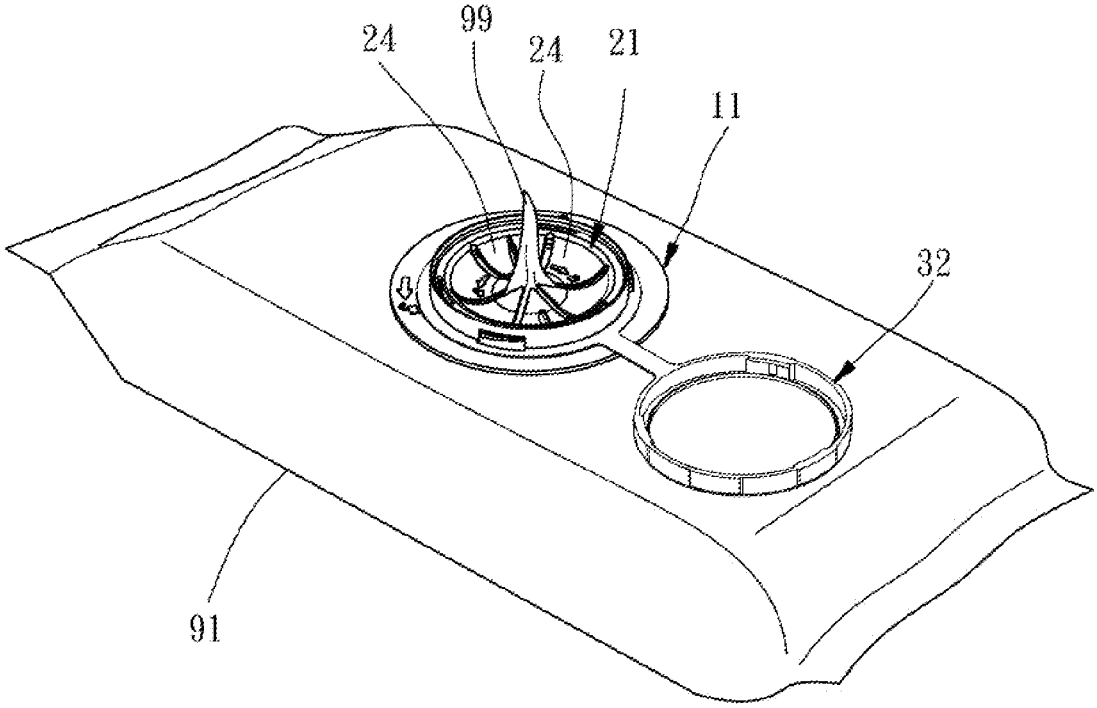
FIG. 7 is a schematic drawing illustrating an application example of the present invention.

Further, the relationship between the cap 32 and the circular upright wall 12 can be so designed that: when capping the cap 32 onto the base ring 11, the topmost edge of the circular upright wall 12 is stopped against a bottom surface of the cover plate 321. This design is as illustrated in FIG. 5. Thus, when the topmost edge of the circular upright wall 12 is stopped against the bottom surface of the cover plate 321, an airtight sealing effect is achieved to prevent quick escape of water vapor from the inside of the container 91 into the outside open air.

Figure 8:
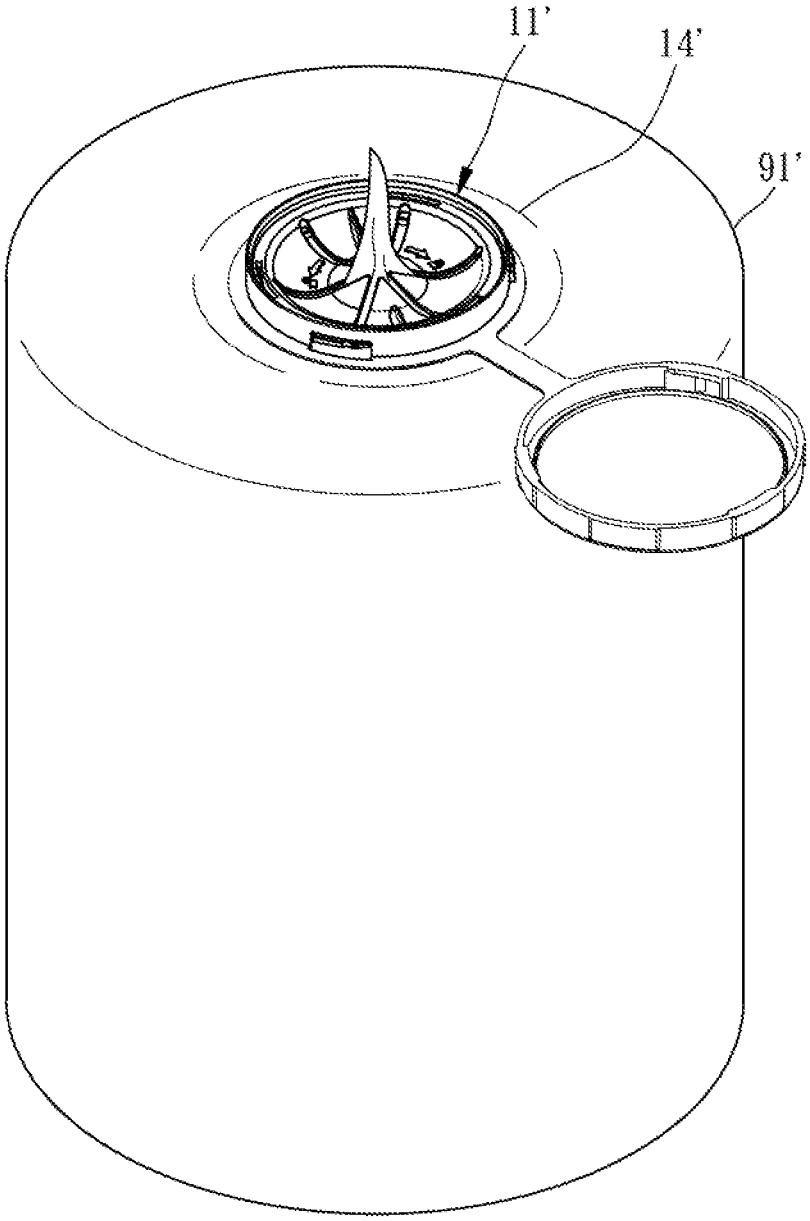
FIG. 8 is a schematic drawing illustrating another application example of the present invention.

Referring to FIG. 8, the base ring 11' can be integrally formed with the outside wall of the container 91' in one piece, for example, the annular shoulder 14' and the container 91' can be made from a plastic material by injection molding. Because the e base ring 11' and the container 91' are made in integrity, it is difficult to point out the border, and therefore the location of the annular shoulder 14' is expressed by dotted lines. According to this design, it is not necessary to affix the base ring 11' to the container 91', bringing more convenience.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wet wipe sealing cap structure, comprising:

a base ring comprising a circular upright wall, an annular shoulder horizontally and outwardly extended from a bottom edge of said circular upright wall, an outer locating unit located at an outer perimeter of said circular upright wall, and an inner locating unit located at an inner perimeter of said circular upright wall;

a claw plate comprising an outer race, a plurality of claws radially inwardly extended from said outer race toward the center of said claw plate and equally spaced from one another, and a claw plate engagement unit located at the periphery of said outer race and detachably engageable with said inner locating unit to secure said claw plate to the inside of said base ring; and a cover device comprising a cap detachably capped on said circular upright wall and positioned between said outer locating unit and said annular shoulder, a collar and a flexible member connected between said cap and said collar, said cap comprising a circular cover plate, a cover wall perpendicularly extended around the border edge of said cover plate and a cover engagement unit located at an inner surface of said cover wall, said cap being detachably downwardly capped on the topmost edge of said circular upright wall with said cover plate facing upwards and said cover wall facing downwards to force said cover engagement unit into friction engagement with said outer locating unit;

wherein said cap further comprises an annular inner wall downwardly extended from a bottom surface of said cover plate, and a bottom slope of a predetermined height located at a bottom part of said annular inner wall; said base ring further comprises a top slope of a predetermined height located at a top part of said circular upright wall and matching said bottom slope of said cap; said bottom slope of said annular inner wall is abutted against said top slope of said circular upright wall when said cap is capped onto said base ring.

2. The wet wipe sealing cap structure as claimed in claim 1, wherein said bottom slope of said annular inner wall is disposed at an outer side relative to said annular inner wall; said top slope of said circular upright wall is disposed at an inner side relative to said circular upright wall.

3. The wet wipe sealing cap structure as claimed in claim 1, wherein said outer locating unit comprises a plurality of sloping ribs formed integral with and equiangularly spaced around the inner perimeter of said circular upright wall; said cover engagement unit comprises a plurality of sloping ribs formed integral with and equiangularly spaced around the inner surface of said cover wall; said collar is fastened to said circular upright wall through a rotary motion.

4. The wet wipe sealing cap structure as claimed in claim 3, wherein the inner diameter of said collar is greater than the outer diameter of said circular upright wall but smaller than the outer diameter defined by said sloping ribs of said outer locating unit.

5. The wet wipe sealing cap structure as claimed in claim 1, wherein said inner locating unit comprises a plurality of sloping ribs formed integral with and equiangularly spaced around the inner perimeter of said circular upright wall; said claw plate engagement unit comprises a plurality of sloping ribs formed integral with and equiangularly spaced around the periphery of said outer race of said claw plate.

6. The wet wipe sealing cap structure as claimed in claim 1, wherein said cap, said collar and said flexible member are integrally formed in one piece.

7. The wet wipe sealing cap structure as claimed in claim 1, wherein said circular upright wall has the topmost edge thereof stopped against a bottom surface of said cover plate when said is capped on said base ring.

8. A wet wipe container comprising:

a wet wipe sealing cap structure, comprising:

a base ring comprising a circular upright wall, an annular shoulder horizontally and outwardly extended from a bottom edge of said circular upright wall, an outer locating unit located at an outer perimeter of said circular upright wall, and an inner locating unit located at an inner perimeter of said circular upright wall;

a claw plate comprising an outer race, a plurality of claws radially inwardly extended from said outer race toward the center of said claw plate and equally spaced from one another, and a claw plate engagement unit located at the periphery of said outer race and detachably engageable with said inner locating unit to secure said claw plate to the inside of said base ring; and a cover device comprising a cap detachably capped on said circular upright wall and positioned between said outer locating unit and said annular shoulder, a collar and a flexible member connected between said cap and said collar, said cap comprising a circular cover plate, a cover wall perpendicularly extended around the border edge of said cover plate and a cover engagement unit located at an inner surface of said cover wall, said cap being detachably downwardly capped on the topmost edge of said circular upright wall with said cover plate facing upwards and said cover wall facing downwards to force said cover engagement unit into friction engagement with said outer locating unit, wherein said cap further comprises an annular inner wall downwardly extended from a bottom surface of said cover plate, and a bottom slope of a predetermined height located at a bottom part of said annular inner wall; said base ring further comprises a top slope of a predetermined height located at a top part of said circular upright wall and matching said bottom slope of said cap; said bottom slope of said annular inner wall is abutted against said top slope of said circular upright wall when said cap is capped onto said base ring, and wherein said annular shoulder is formed integral with said container in one piece.

* * * * *